US006543752B2

(12) United States Patent
Gerhardy

(10) Patent No.: US 6,543,752 B2
(45) Date of Patent: Apr. 8, 2003

(54) CARBURETOR FOR AN INTERNAL COMBUSTION ENGINE AND INCLUDING AT LEAST ONE ADJUSTING SCREW

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/948,346

(22) Filed: Sep. 6, 2001

(65) Prior Publication Data

US 2002/0027299 A1 Mar. 7, 2002

(30) Foreign Application Priority Data

Sep. 6, 2000 (DE) ..... 100 44 025

(51) Int. Cl.[7] ..... F02M 3/08
(52) U.S. Cl. ..... 261/71; 261/DIG. 38
(58) Field of Search ..... 261/71, DIG. 38, 261/DIG. 84; 137/382, 382.5

(56) References Cited

U.S. PATENT DOCUMENTS 3,618,906 A * 11/1971 Charron ..... 261/71 X
4,094,932 A * 6/1978 Knox, Sr. ..... 261/DIG. 38
4,097,561 A * 6/1978 Seki et al. ..... 261/DIG. 38
4,271,095 A * 6/1981 Maeda ..... 261/DIG. 38
4,759,883 A * 7/1988 Woody et al. ..... 261/DIG. 38
4,812,266 A * 3/1989 Fanner ..... 261/DIG. 38
5,322,645 A * 6/1994 Hammett et al. .... 261/DIG. 84
5,538,673 A * 7/1996 Edmonston ..... 261/DIG. 38
5,635,113 A * 6/1997 Walsh et al. ..... 261/71
5,753,148 A * 5/1998 King et al. ..... 261/71
5,772,927 A * 6/1998 Koizumi et al. ..... 261/71 X
6,003,845 A * 12/1999 Kus ..... 261/DIG. 84

FOREIGN PATENT DOCUMENTS

DE 3005854 C2 6/1990
JP 47-42424 * 10/1972 ..... 261/DIG. 84

* cited by examiner

*Primary Examiner*—Richard L. Chiesa
(74) *Attorney, Agent, or Firm*—R W Becker & Associates; R W Becker

(57) ABSTRACT

A carburetor for an internal combustion engine is provided and includes at least one adjusting screw disposed in a housing for regulating the fuel/air mixture. The adjusting screw is screwed into a bore of the carburetor housing. The adjusting screw is embodied as a cheese head screw, whereby one end of the screw is provided with two slots that are cross-shaped relative to one another and extend over the diameter of the cheese head screw.

15 Claims, 2 Drawing Sheets

CARBURETOR FOR AN INTERNAL COMBUSTION ENGINE AND INCLUDING AT LEAST ONE ADJUSTING SCREW

BACKGROUND OF THE INVENTION

The present invention relates to a carburetor for an internal combustion engine, and includes at least one adjusting screw.

DE 30 05 854 C2 discloses a carburetor having screws to adjust the carburetor. These screws are embodied as socket-head cap screws or set screws that are provided with a slot for the application of a tool. The screws are in engagement with threaded bores of the housing. At that end that is opposite the head, the screws are embodied as a cone or a needle. By turning these screws, the cross-sectional areas of fuel nozzles and the idle setting of the butterfly valve of the carburetor can be altered, and hence the fuel/air mixture drawn in by an internal combustion engine through the carburetor can be regulated. Such carburetors are preferably utilized with two-stroke internal combustion engines for manually guided implements, whereby an adjustment of the carburetor is required as a function of carbon monoxide and speed when the internal combustion engine is running.

To adjust the carburetor, fully automatic adjustment and measurement compartments are used into which the adjustment screws on the carburetor are moved and rotated by automatically controlled adjustment knobs using an adjustment tool. With the known slotted screws, an adjustment tool can often only be brought into engagement with the screw slot after passing through a large angle of rotation. The screw slots are not suitable for centering the tool. In addition, the known socket-head cap screws, due to the fact that their heads are formed by swaging or other deformation, are not true to shape, which can be a drawback with regard to the precision of adjustment of the fuel nozzles.

It is therefore an object of the present invention to provide a carburetor that has at least one adjusting screw and that enables a precise rapid adjustment of the carburetor.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
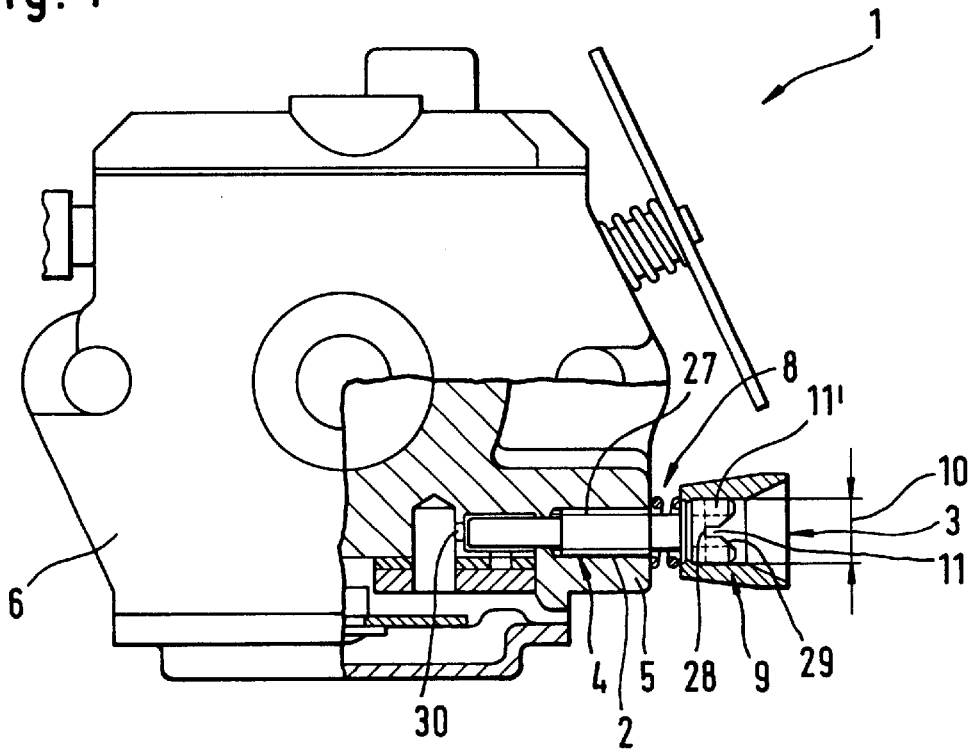
FIG. 1 is a partially cross-sectioned view through one exemplary embodiment of an inventive carburetor having an adjusting screw.

The carburetor of the present invention comprises at least one adjusting screw that is disposed in a carburetor housing for regulating a fuel/air mixture, wherein the adjusting screw is embodied as a cheese head screw and has a threaded portion for being threadedly received in a threaded portion of a bore of the carburetor housing; one end of the cheese head screw extends out of the carburetor housing and is provided with two slots that extend in a cross-shaped manner relative to one another, wherein the slots extend over the diameter of the screw.

The slots preferably have approximately the same depth; in addition, it is expedient that the rims of the slots be beveled to the axial ends of the screw. A blind hole is advantageously axially guided into the screw at the point of intersection of the slots. The diameter of the blind hole is preferably approximately twice as great as the width of the slots, and preferably significantly deeper that the slots so that a central point of the adjustment tool can penetrate therein accompanied by a positive engagement. That end of the cheese head screw that is disposed opposite the slots can be embodied as a pin that acts upon an opening in the carburetor housing. The quantity of fuel can be defined as a function of how far the adjusting screw is screwed in. It can be expedient to provide a pointed end or a needle on the end face of the pin that then acts as a flow control means. Instead of the pin, a cone or a pointed tip can also be provided on the adjusting screw. Pursuant to a further specific embodiment of the present invention, the cheese head screw is manufactured exclusively from round stock by machining. As a result of this structural feature, it is in particular possible for the adjusting screw to be absolutely free of rifling.

For an improved coupling of the centering tip of the adjustment tool on the cheese head screw, the blind hole is provided at the point of intersection of the slots, and the slot rims are beveled. It can be expedient, in addition to the thus already formed centering aid, to fix a centering device in position upon a widened portion of the cheese head screw. Particularly suitable for this purpose is a ring having an opening that is embodied as a funnel. In this connection, the smallest inner diameter at the base of the centering device is approximately as large as the diameter of the screw on that side on which the slots are milled in. The centering device is preferably inserted over the end of the screw that is opposite from the slots, and is screwed onto the widened portion via a thread or is held on the end of the screw via a clip or snap-type connection. Alternatively, other means could also be provided for a positively engaging connection. As a result of the aforementioned structural features, a rapid approach and rotation of the adjusting screw is possible with the aid of automatic adjustment tools. The end of the adjusting screw that is provided with the slots forms together with the adjustment tool to a certain extent a universal coupling. Position tolerances and relative movements due to vibrations when the adjusting tool approaches the adjusting screw are thereby possible to a certain extent. Providing the end of the adjusting screw with the slots furthermore makes it possible to introduce a normal screwing tool, for example a screwdriver, to the extent that during later operation of the implement a readjustment is required.

Further specific features of the present invention will be described in detail subsequently.

DESCRIPTION OF PREFERRED EMBODIMENTS

Referring now to the drawings in detail, a carburetor 1, as shown in FIG. 1, of an internal combustion engine is provided with a plurality of adjusting screws for regulating the fuel/air mixture; in the partial cross section of FIG. 1, only one adjusting screw 3 is visible. The adjusting screw 3 includes a portion having a thread 27 for being threaded into a corresponding threaded portion 2 of a bore 4 of a receiving part 5 on a carburetor housing 6. The adjusting screw 3 is held in the bore 4 in a self-locking manner, and the adjusting screw can be turned by overcoming the locking force. In the illustrated embodiment, the adjusting screw 3 is formed as a cylindrical or cheese head screw 8 by machining round stock. During the manufacture of the adjusting screw 3, a swaging deformation is dispensed with. This enables a high precision of the adjusting screw 3, especially a high rotatational symmetry of the adjusting screw about its longitudinal axis.

Disposed at one end 9 of the cheese head screw 8 are two slots 11,11' that are arranged in a cross-shaped manner relative to one another, and which extend over the entire diameter 10 of the screw. The two slots 11,11' have the same depth 12, as can be clearly seen from FIG. 2. Starting from the base 28, the cross section of the slots 11,11' is rectangular, with the slots having a V-shaped widening in a direction toward their axial rims 13. Each V-shaped widened portion of the slots 11,11' is effected by a bevel 29 on both sides of the axial slot rims. By providing a widened portion that is about twice as wide as the width of the slot at the base thereof, it is possible to rapidly center a non-illustrated automatically controlled adjusting tool in the screw head.

Figure 2:
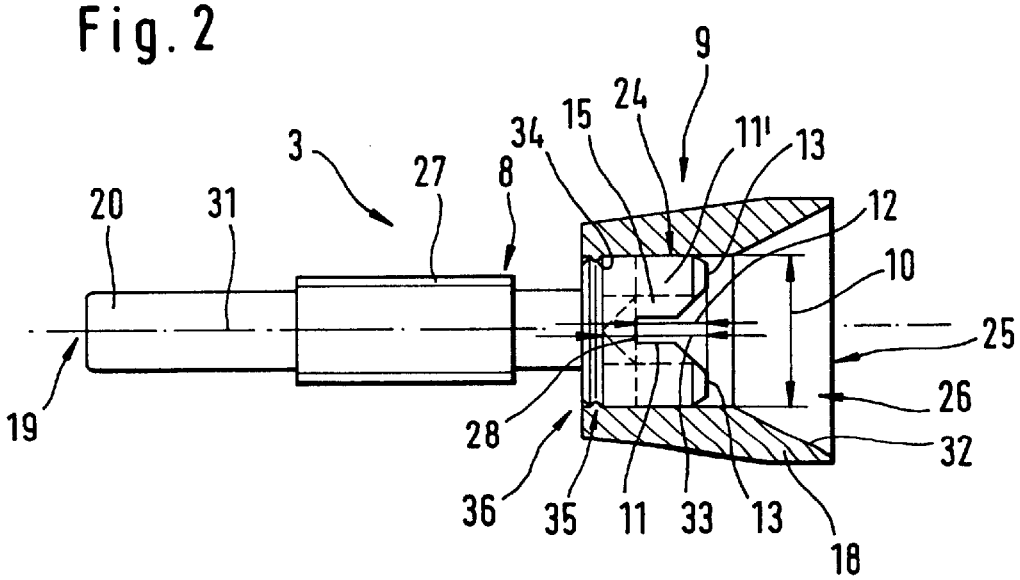
FIG. 2 shows the adjusting screw as an individual component.
Figure 3:
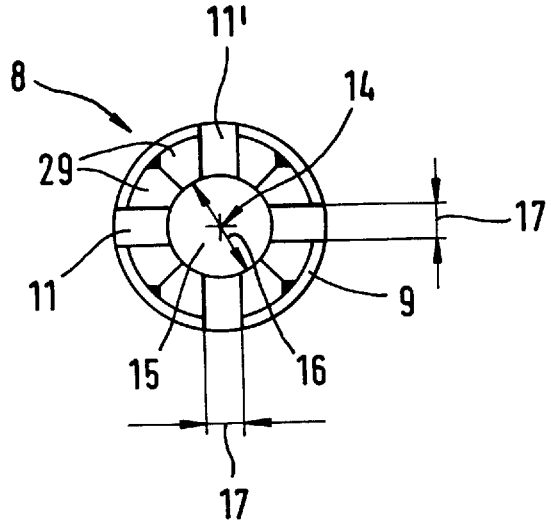
FIG. 3 is a view of a head of an adjusting screw.
Figure 4:
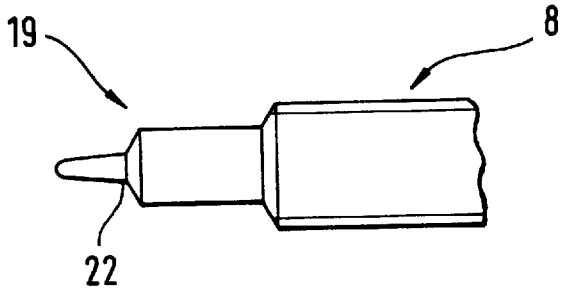
FIG. 4 is a view of a needle on an adjusting screw.
Figure 5:
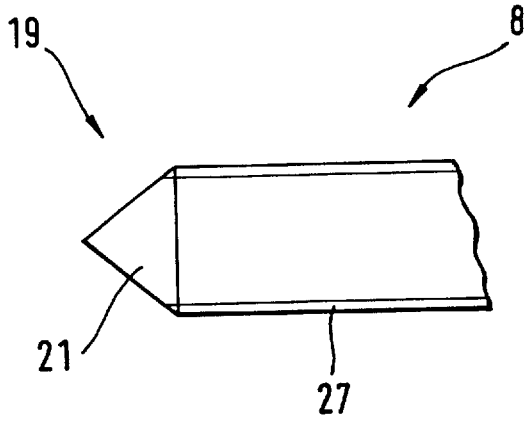
FIG. 5 is a view of a pointed tip on an adjusting screw.

FIG. 2 shows the adjusting screw 3 as an individual component. The end 9 of the adjusting screw 3 is embodied as a widened portion 24. As can be clearly seen in FIG. 3 a blind hole 15 is introduced into the portion or head 24 of the cheese head screw 8 coaxial to the longitudinal axis 31 of the adjusting screw 3 and to a point of intersection 14 of the slots 11,11'. The diameter 16 of the blind hole 15 is greater than, preferably three times as great as, the width 17 of the slots 11,11'. To allow more penetration of the centering tip of the adjusting tool, the depth 33 of the blind hole 15 is greater than the depth 12 of the slots 11,11'. The blind hole 15 and the phases or bevels 29 at the rims 13 of the slot 11,11' provide the interior of the end 9 of the cheese head screw 8 with a funnel-shaped configuration, thereby enhancing a rapid starting and centering of an adjustment tool. The other end 19 of the adjusting screw 3 is provided with a cylindrical pin 20. The pin 20 cooperates with an opening 30 in the carburetor housing 6 as can be seen from FIG. 1, and in this manner forms an adjustable flow control device. In this connection, it can be expedient to provide the end face of the cylindrical pin 20 with a needle or pointed end 22, as shown in FIG. 4. Furthermore, in place of the pin 20 it is possible to form a pointed tip 21 on the threaded portion 27, as shown in FIG. 5. The pin 20 comes to rest against the opening 30 in a precise rotationally symmetrical manner, since the adjusting screw 3 is produced exclusively by machining. Thus, distortion of the screw, for example due to deforming processing steps, is precluded during the manufacture of the screw.

It can also be seen from FIG. 2 that a centering device 25 in the form of a ring 18 is mounted on the widened portion 24 of the cheese head screw 8; the ring 18 has a considerably greater length than does the portion 24. Since on that side that faces the threaded portion 27 the ring 18 is essentially flush with the portion 24, on the other side of the portion 24 the ring 18 projects therefrom. At this location, the ring 18 has an internal taper 32 by means of which a funnel 26 is formed that facilitates the introduction of a tool for the adjustment of the cheese head screw 8 in the carburetor. The ring 18 is preferably secured to the portion 24 by positive or form-locking connecting means, whereby such connecting means can be embodied as threads or as a collar 35 that engages in an annular groove 34. The annular groove 34, as viewed in the axial direction of the cheese head screw 8, is provided in the head of the screw 8 at the end 36 of the portion 24. The end 36 of the portion 24 faces the threaded shaft. The collar 35 projects in a saw tooth fashion out of the contour of the inner diameter of the ring 18. The inner diameter of the ring 18 is approximately equivalent to the diameter 10 of the portion 24 of the cheese head screw 8. The clip-type connection formed by the annular groove 34 and the collar 35 effects an axial, detachable fixing of the ring 18 in position upon the portion 24. It can be expedient to spray the ring 18 onto the portion 24 as a sprayed die casting of polymeric material.

The specification incorporates by reference the disclosure of German priority document 100 44 025.8 filed Sep. 6, 2000.

The present invention is, of course, in no way restricted to the specific disclosure of the specification and drawings, but also encompasses any modifications within the scope of the appended claims.

I claim:

1. A carburetor for an internal combustion engine comprising:

a carburetor housing; and at least one adjusting screw disposed in said carburetor housing for regulating a fuel/air mixture, wherein said at least one adjusting screw is embodied as a cheese head screw and has a threaded portion for being threadedly received in a threaded portion of a bore of said carburetor housing, wherein said cheese head screw has an end that extends out of said housing and is provided with two slots that extend in a cross-shaped manner relative to one another, wherein said slots extend over a diameter of said cheese head screw, and wherein axial rims of said slots are beveled at said end of said cheese head screw.

2. A carburetor according to claim 1, wherein said slots have the same depth.

3. A carburetor according to claim 1, wherein an axially extending blind hole is disposed at a point where said slots intersect.

4. A carburetor according to claim 3, wherein said blind hole has a diameter that is greater than a width of said slots.

5. A carburetor according to claim 4, wherein said diameter of said blind hole is approximately three times as great as said width of said slots.

6. A carburetor according to claim 3, wherein said blind hole has a depth that is greater than a depth of said slots.

7. A carburetor according to claim 1, wherein an end of said cheese head screw that is opposite said slots is a pin.

8. A carburetor according to claim 1, wherein an end of said cheese head screw that is opposite said slots is a pointed tip.

9. A carburetor according to claim 1, wherein an end of said cheese head screw that is opposite said slots is a needle or pointed end.

10. A carburetor according to claim 1, wherein said end of said cheese head screw that is provided with said slots is furthermore provided with a widened portion, and wherein a centering device is secured on said widened portion.

11. A carburetor according to claim 10, wherein said centering device comprises a ring that forms a funnel.

12. A carburetor according to claim 11, wherein said ring is held on said widened portion by means of a positive engagement connection.

13. A carburetor according to claim 12, wherein said ring is sprayed onto said widened portion as a sprayed dye casting of polymeric material, or is snap-fitted onto said widened portion.

14. A carburetor according to claim 12, wherein said positive engagement connection is a snap connection effected by an annular groove in said widened portion and by a collar that is formed on an inner surface of said ring and engages said annular groove.

15. A carburetor according to claim 1, wherein said cheese head screw is produced exclusively by a machining process.

* * * * *